United States Patent [19]

Laurent

[11] Patent Number: 4,488,537

[45] Date of Patent: Dec. 18, 1984

[54] METHOD AND INSTALLATION FOR IMPROVING THE EFFICIENCY OF A SUBMERGED-COMBUSTION HEATING INSTALLATION

[76] Inventor: Francois Laurent, 1, montee Notre Dame, 35400 Saint Malo, France

[21] Appl. No.: 537,226

[22] Filed: Sep. 29, 1983

[30] Foreign Application Priority Data

Apr. 7, 1982 [FR] France ..... 82 06038

[51] Int. Cl.[3] ..... F24H 1/20

[52] U.S. Cl. ..... 126/360 A; 126/360 R; 431/31; 431/3

[58] Field of Search ..... 126/360 A, 360 R, 351, 126/366, 367, 368; 431/20, 31, 30, 29, 3, 6, 12, 121, 254, 265; 122/23, 448 R

[56] References Cited

U.S. PATENT DOCUMENTS 3,162,234 12/1964 Hamelink ..... 431/31

4,299,555 11/1981 Kamberg ..... 431/31 X

OTHER PUBLICATIONS

"Submerged Combustion", Operating & Service Instructions, Submerged Combustion Co. of America, Inc.

*Primary Examiner*—Randall L. Green

*Attorney, Agent, or Firm*—Pollock, Vande Sande & Priddy

[57] ABSTRACT

The invention relates to a method and installation for improving the efficiency of a submerged-combustion heating installation. According to the invention, to prevent thermal stresses injurious to the combustion chamber (3) and avoid the production or penetration of vapors into the top part of the chamber (16), the installation is ventilated (7) with air after the burners (1) have been turned off, for at least sufficient time for adequately cooling the walls of the combustion chamber (3).

1 Claim, 2 Drawing Figures

METHOD AND INSTALLATION FOR IMPROVING THE EFFICIENCY OF A SUBMERGED-COMBUSTION HEATING INSTALLATION

FIELD OF THE INVENTION

The invention relates to a method and installation for improving the efficiency of a submerged combustion heating installation.

BACKGROUND OF THE INVENTION

Installations using submerged combustion boilers are used for various applications, including industrial heating, swimming pool heating, and the like.

The advantage of such installations is that most of the latent heat of condensation of the vapor is recovered, since the combustion gases are bubbled through the water to be heated. The resulting efficiency, calculated from the lower calorific value, is above 100% and frequently in the order of 105%.

This attractive technique, however, has a number of difficulties inherent in combustion occurring in a submerged medium. The installation requires a fuel supply (e.g. gas or fuel oil), a supply of combustion air pressurized by a fan or the like, an automatic ignition device comprising a spark plug or the like, and a programmer which successively and automatically, at appropriate moments, turns on the fuel supply or the burner ignition or stops the fuel supply when the desired operating temperature has been reached. The burners operate in an enclosed, submerged combustion chamber and consequently, for safety and to avoid any risk of explosion, the air in the chamber has to be scavenged before ignition and after extinction of the boilers. These cycles are controlled by the programmer.

Since, however, the combustion chamber has relatively high thermal inertia and may be brought to temperatures near 1000° C. during combustion, difficulties occur during each operating cycle because water rises into the combustion chamber when it is still hot after post-scavenging, thus subjecting the chamber to severe thermal stresses and possibly cracking it, and vapor and moist air rise through the installation and may interfere with the electric components, including the ignition.

BRIEF DESCRIPTION OF THE INVENTION

The invention aims to avoid the aforementioned disadvantages.

In accordance with the method according to the invention, after the burners have been turned off, the installation is ventilated with air for at least sufficient time, e.g. for several minutes, to cool the combustion chamber walls to a temperature near or below 100° C. This completely eliminates the problem of stress due to abrupt cooling by water rising in the combustion chamber and simultaneous production of water vapor, which interferes with efficiency.

In a preferred embodiment, the process is easily put into practice by controlling the pressurized combustion air supply independently of the programmer, as soon as the installation is energized, via a delayed-opening relay supplied by the circuit for energizing the installation and closing as soon as the installation starts. Thus, a flow of combustion air will be kept up permanently in the installation and when it is stopped, e.g. at the end of the day if the cycle is a daily one, the delayed-opening relay will keep combustion air flowing in the installation for long enough to cool the chamber thoroughly.

According to another advantageous feature of the invention, the circuit in the installation for blowing combustion air also comprises a branch circuit which blows air on to the ignition spark plugs or the like and is actuated by a solenoid valve via a delayed-closure relay energized by the programmer at each beginning of an ignition cycle. In this manner, dry combustion air is blown on to the spark plug electrodes at the beginning of each ignition cycle, before ignition is brought about by energizing the spark plugs, so that the electrodes are freed from any trace of moisture and there are no problems in starting at the beginning of each cycle.

The invention will be more readily understood from the following description with reference to the accompanying drawings in which:

FIG. 1 is a diagram of a conventional submerged-combustion installation, and FIG. 2 is a diagram of the same installation but modified and improved according to the invention.

DETAILED DESCRIPTION OF THE INVENTION

Figure 1:
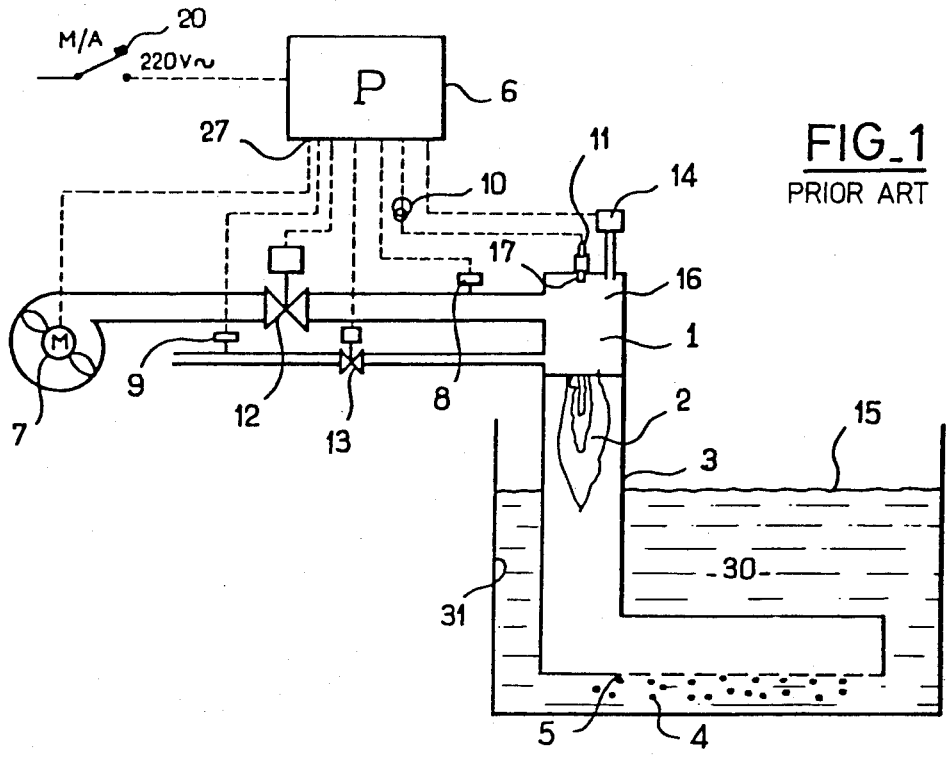
FIG 1 PRIOR ART

A description of a conventional installation is illustrated in FIG. 1.

The installation comprises a jet or other burner 1 producing a vertical flame 2 extending downwards into a chamber 3 comprising the combustion chamber and having a metal wall in one or more layers. The combustion product or gases escape in the form of bubbles 4 through holes 5 at the bottom of chamber 3 directly into a bath 30 to be heated, the bath usually being of water in a suitable vessel or chamber 31 below the bath level 15.

The operating cycle (ignition and extinction) of the burner is controlled by an approved programmer 6 which must meet precise specifications defined by the public authorities. Programmer 6 controls motor 7 of a combustion air fan, checks that the air pressure measured at 8 and the gas pressure measured at 9 are suitable, and sends an ignition command via a high-voltage transformer 10 to an ignition spark plug 11. The programmer also gives command to solenoid valves for air 12 and gas 13 and checks the presence of a flame via a detector 14.

At the beginning of the cycle, the programmer pre-scavenges the installation, i.e. scavenges the combustion chamber assembly 3 with air only, the air pressure needing to be higher than the hydrostatic pressure of the liquid in bath 30. The pre-scavenging time is of the order of a minute. Next, if the air and gas pressures are suitable, programmer 6 energizes the ignition transformer 10 and the burner ignites.

At the end of the cycle, i.e. when bath 30 has reached the desired temperature, programmer 6 closes the fuel solenoid 13 and carries out post-scavenging, i.e. subsequent ventilation of the equipment by continuing to send air via fan 7 through the entire installation for a time of the order of 30 seconds.

This method of operation, if it meets the specifications in force in most countries and applying to boilers, has the following disadvantages when specifically applied to direct heating by combustion products:

(1) When the installation stops, the liquid in bath 30 rises too rapidly inside chamber 3. The inner metal surface, which has been brought to a temperature of the order of 1000° C., is abruptly cooled, resulting in considerable thermal stresses and damaging and possibly cracking it. Another result is that the liquid evaporates, producing vapor tension as far as the air and gas solenoids 12, 13 and the pressure intake diaphragms 8 and 9. The compressed vapor may also reach fan 7. The vapor, which is at a temperature of above 100° C., also damages the previously mentioned components, which are usually designed for operating temperatures not above 50° C. and not easily adapted to high humidity.

(2) When the installation is adjusted, i.e. during a temporary stoppage between two operating cycles when the bath does not need to be heated (during on/off operation) the problems are the same, since the programmer carries out post-scavenging as previously described and waits for a command from the temperature probe before restarting. In other words, the previously mentioned disadvantages resulting from stopping the installation occur between each two successive operating cycles.

(3) Ignition is unreliable, since the installation is brought to a complete stop at the end of operation and a moist atmosphere forms in the top part 16 of chamber 3 and the electrode 17 of spark plugs 11 are moist. The installation may not ignite, thus annoying the user. The same disadvantage occurs during normal operation between two cycles.

Figure 2:
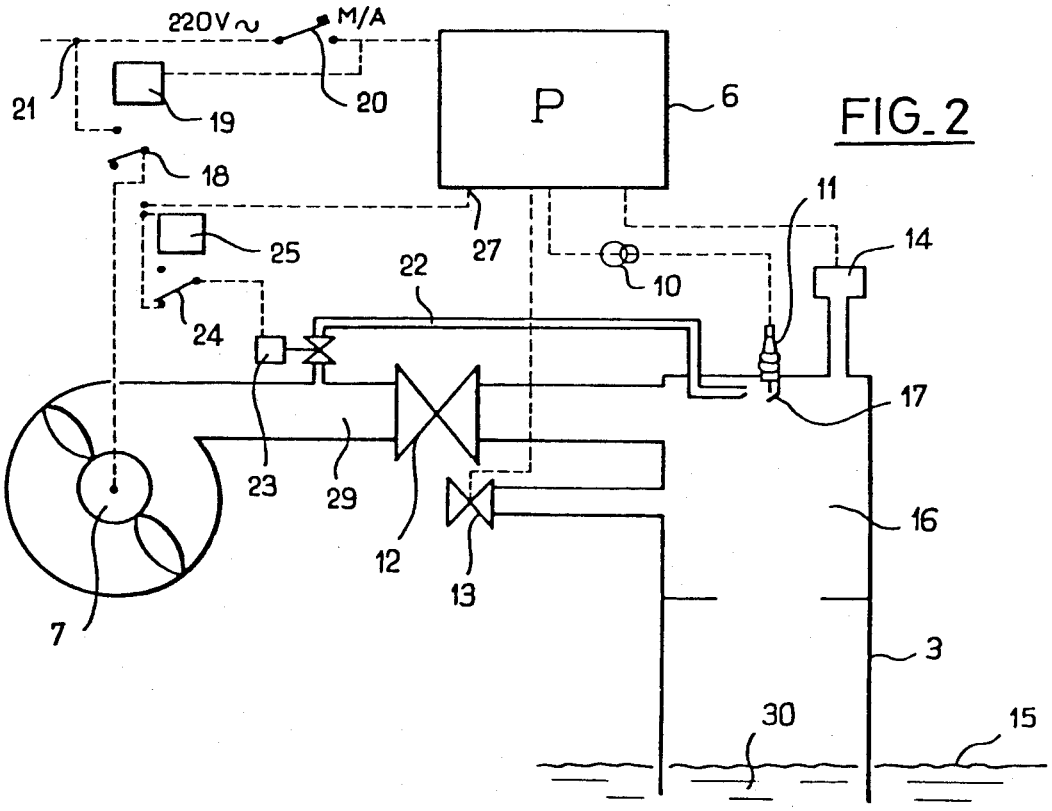

FIG. 2 shows the installation modified according to the invention, like references being used for like components.

According to the invention, fan motor 7 is not energized by a line 27 from programmer 6 but directly by a line 21 connected to the line supplying current to the installation, which is actuated by a conventional relay 19 having a delayed-opening contact 18, relay 19 being supplied via the stop/go button 20 of the installation.

As can be seen, as long as button 20 is closed, motor 7 will be energized and keep the air in the installation under pressure, thus completely preventing any liquid rising from bath 30 into combustion chamber 3.

When the installation stops, e.g. at the end of the day, i.e. when button 20 is opened, motor 7 continues to be energized by line 21 because of the delayed opening of contacts 18, thus cooling the wall of combustion chamber 3 as required. The delay will be sufficient to ensure that the temperature of the inner wall of chamber 3 is not substantially above 100° C. In the case of conventional power installations, the delay can be of the order of 8 to 10 minutes approximately. Consequently, fan 7 operates permanently when the installation is under thermal stress and post-scavenging at the end of the operation continues for sufficient time, using an approved programmer, without requiring any substantial modification of the installation.

With regard to reliability of ignition, according to another feature of the invention, air is blown on to spark plugs electrodes 17 via a tube 22 supplied by a solenoid valve 23 and branching from the main air-blowing circuit 29 of the fan.

At the beginning of an operation cycle, when button 20 is closed, relay 19 is energized and contact 18 is closed. As a result, fan 7 becomes operative. Simultaneously, line 27 is energized and controls relay 25, the closing of which is delayed while valve 23 is opened. As a consequence, at the beginning of the operation cycle and during the pre-scavenging period, spark plug 11 is effectively blown dry by air flowing through tube 22 which is located downstream from air blowing circuit 29. However, after a delay of approximately 30 seconds, contact 24 of relay 25 is closed and valve 23 is closed. As a result, there is no possibility for the spark plug to be subjected to additional forced air at an undesired time. This completely prevents the production of water vapour in the top part 16 of the combustion chamber, and also efficiently removes all trace of moisture from electrodes 17 at the beginning of each ignition cycle.

I claim:

1. A method for improving the efficiency of a heating system having a submerged combustion chamber surrounded by liquid and burners connected thereto, the steps comprising:

igniting the burners;

generating forced air which flows past the ignited burners and the inside walls of the chamber thereby heating the air prior to its mixing with the liquid through a submerged outlet of the combustion chamber;

extinguishing the burners when the liquid attains a preselected temperature;

continuing to generate forced air, after the burners are extinguished, for a preselected delay time corresponding to a time interval sufficient for the walls of the combustion chamber to be cooled to a temperature at or below 100° C. thereby improving the stress resistance of the chamber;

creating a parallel branch for the forced air which extends to a point adjacent a burner ignition means;

opening the branch for a preselected time interval prior to each burner ignition thereby exposing the burner ignition means to the forced air which removes liquid vapor and prevents the passage of liquid vapor from the submerged outlet to the burner ignition means which would otherwise impair burner ignition.

* * * * *